US007886932B2

(12) United States Patent
Yanagisawa et al.

(10) Patent No.: US 7,886,932 B2
(45) Date of Patent: Feb. 15, 2011

(54) VENDING MACHINE HAVING A COMMODITY COLUMN

(75) Inventors: Yuuki Yanagisawa, Isesaki (JP); Takeshi Onda, Isesaki (JP); Toshihiko Kurihara, Isesaki (JP); Masaru Tsunoda, Isesaki (JP); Yoshitaka Watanabe, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 0 days.

(21) Appl. No.: 12/133,073

(22) Filed: Jun. 4, 2008

(65) Prior Publication Data

US 2008/0302813 A1 Dec. 11, 2008

(30) Foreign Application Priority Data

Jun. 11, 2007 (JP) ..... 2007-154272

(51) Int. Cl.
*G07F 11/00* (2006.01)

(52) U.S. Cl. ..... 221/197; 221/124; 221/99; 221/129

(58) Field of Classification Search ..... 221/1–312 C
See application file for complete search history.

(56) References Cited

U.S. PATENT DOCUMENTS 3,320,010 A * 5/1967 Ritzerfeld ..... 312/323
3,990,754 A * 11/1976 Pitel et al. ..... 312/35
4,725,108 A * 2/1988 Wilson ..... 312/323
5,718,341 A * 2/1998 Robertson ..... 211/59.2
6,360,901 B1 * 3/2002 Parham ..... 211/59.2
6,582,037 B1 * 6/2003 Rudick et al. ..... 312/334.22
7,451,891 B2 * 11/2008 Carter et al. ..... 221/210
2001/0000609 A1 * 5/2001 Rudick et al. ..... 221/6
2006/0238082 A1 * 10/2006 Heidemann et al. ..... 312/131

(Continued)

FOREIGN PATENT DOCUMENTS

DE 29707628 U1 7/1997

(Continued)

OTHER PUBLICATIONS

European Patent Office, European Search Report for Application No. EP08157357, dated Mar. 13, 2009. (Counterpart of above-captioned U.S. patent application).

*Primary Examiner*—Gene Crawford
*Assistant Examiner*—Michael K Collins
(74) *Attorney, Agent, or Firm*—Baker Botts L.L.P.

(57) ABSTRACT

A vending machine has a support part that has a first support member extending in the right and left direction on the inside of a commodity storage chamber and a second support member extending in the front and rear direction on the inside of the commodity storage chamber, and supports a commodity column so that the commodity column is movable in the front and rear direction on the first and second support members. In the vending machine, when a support receiving part is detached from the first support member, the commodity column can be moved in the front and rear direction via the second support member, so that replenishment of commodities to the commodity column and maintenance of the commodity column can be accomplished. Both of the first support member and the second support members are located under the commodity column, and support the commodity column from the downside. Therefore, spaces for arranging support members at the right and left of the commodity column are unnecessary.

8 Claims, 7 Drawing Sheets

U.S. PATENT DOCUMENTS

2006/0261080 A1 11/2006 Matsumoto et al.
2007/0221680 A1* 9/2007 Yuyama ..... 221/124
2008/0083769 A1* 4/2008 Yuyama et al. ..... 221/1

FOREIGN PATENT DOCUMENTS

EP 1724732 A1 11/2006
JP 2006-318258 A 11/2006
WO 2004/047033 A1 6/2004
WO 2004/107279 A2 12/2004

* cited by examiner

VENDING MACHINE HAVING A COMMODITY COLUMN

CROSS-REFERENCE TO RELATED APPLICATION

This application claims the benefit of Japanese Patent Application No. 2007-154272, filed Jun. 11, 2007, the disclosure of which is incorporated herein by reference in its entirety.

BACKGROUND OF THE INVENTION

1. Field of the Invention

The present invention relates to a vending machine having commodity columns on which commodities are arranged in the front and rear direction.

2. Description of the Related Art

Conventionally, the commodity column of this type has been proposed in various modes. Generally, a commodity column in which a commodity passage is formed by a bottom wall on which commodities are placed and side walls extending at the right and left of the bottom wall has been known. For the commodity column of this type, when a commodity on the commodity column is carried out, a pusher provided on the bottom wall of the commodity column is driven to push out the rear commodity to the front, by which commodities are dropped and carried out one by one in order from the commodity in the front row (for example, the commodity column described in Japanese Patent Publication 2006-318258).

When commodities are replenished on the commodity column, or when the commodity column is repaired or serviced, each commodity column is pulled out to the front, or the commodity column having been pulled out to the front is removed, by which the commodity replenishing work or the repairing work is performed. To carry out the pulling-out operation or the removing operation of each commodity column as described above, a support member extending in the front and rear direction is formed between the adjacent commodity columns so that the commodity column can be pulled out to the front via this support member.

For the conventional commodity column, since commodities are arranged in one row only, commodity columns corresponding to the number of commodity rows must be provided, and accordingly the number of support member arrangement spaces between the commodity columns increases.

Although each support member arrangement space between the commodity columns is narrow, since the number of commodity columns is large, the total width of the spaces is very wide, which is a major cause for decreasing the commodity storage capacity of the vending machine.

SUMMARY OF THE INVENTION

The present invention has been made to solve problems with the related art, and accordingly an object thereof is to provide a vending machine in which support members for commodity columns are arranged under the commodity columns, so that spaces for arranging support members at the right and left of commodity column is unnecessary, whereby the commodity storage capacity can be increased.

The vending machine in accordance with the present invention has a configuration including a commodity column in which commodities are arranged in the front and rear direction; a support part having a first support member extending in the right and left direction on the inside of a commodity storage chamber and a second support member extending in the front and rear direction on the inside of the commodity storage chamber, and wherein the commodity column is supported by the support part so that the commodity column is capable of moving in the front and rear direction on the first and second support members; a support receiving part which is supported so as to be freely engaged with and disengaged from the first support member, and is formed under the commodity column so as to regulate the movement in the front and rear direction of the commodity column; and a right and left regulating parts which regulate the movement in the right and left direction of the commodity column so as to cover the second support member from the outside.

According to the present invention, when the support receiving part is detached from the first support member, the commodity column can be moved in the front and rear direction via the second support members, so that replenishment of commodities to the commodity column and maintenance of the commodity column can be accomplished. Both of the first support member and the second support members are located under the commodity column, and support the commodity column from the downside. Therefore, spaces for arranging support members at the right and left of the commodity column are unnecessary.

The above and other objects, features, and advantages of the present invention will become apparent from the following description and the accompanying drawings.

DESCRIPTION OF THE PREFERRED EMBODIMENTS

FIGS. 1 to 8 show one embodiment of a vending machine in accordance with the present invention.

The general configuration of the vending machine in accordance with this embodiment is explained with reference to FIGS. 1 and 2.

Figure 1:
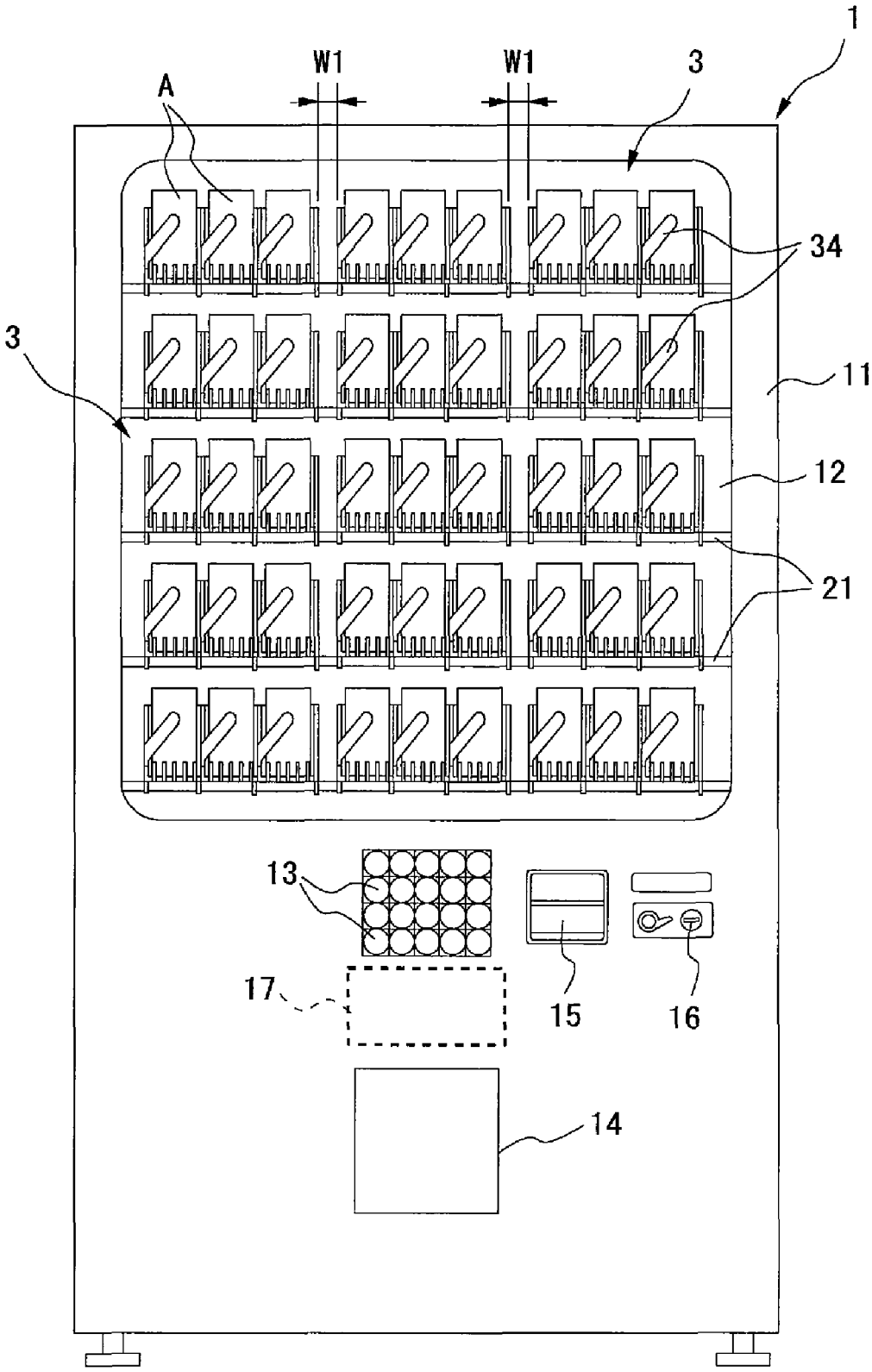
FIG. 1 is a front view of a vending machine.

As shown in FIG. 1, an outer door 11 is provided in front of a vending machine 1 so as to be capable of being opened and closed. The outer door 11 is provided with a commodity see-through window 12, a commodity selection button 13, a commodity takeout port 14, a bill charging device 15, a coin charging port 16, a bucket mechanism 17 for carrying commodities, and the like.

Figure 2:
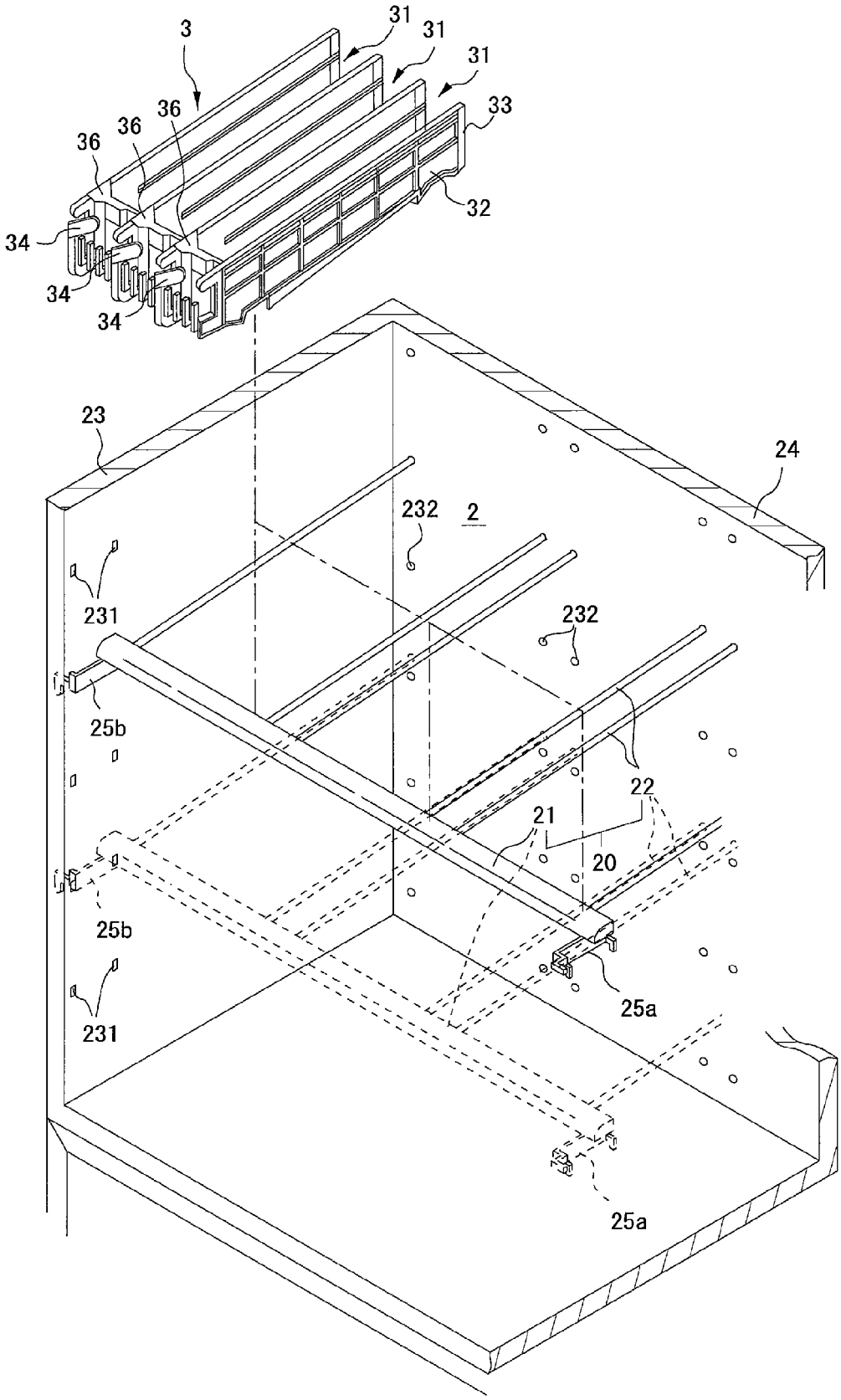
FIG. 2 is an exploded perspective view showing a method for assembling a commodity column.

As shown in FIG. 2, a commodity storage chamber 2 is formed on the inside of the outer door 11. On the inside of the commodity storage chamber 2, support parts 20 provided under a commodity column 3, described later, are arranged in a plurality of tiers vertically. Each of the support parts 20 has a first support member 21 extending in the right and left direction of the commodity storage chamber 2 and second support members 22 extending in the front and rear direction. In the inner surfaces of the right and left side walls 23 of the commodity storage chamber 2, two side surface hook holes 231 arranged at predetermined intervals vertically are formed, and on the other hand, in a back wall 24 of the commodity storage chamber 2, back surface hook holes 232 are formed vertically in the same manner. These holes 231 and 232 hold the first support members 21 and the second support members 22 in the commodity storage chamber 2. Hereunder, this holding structure is explained.

Figure 3:
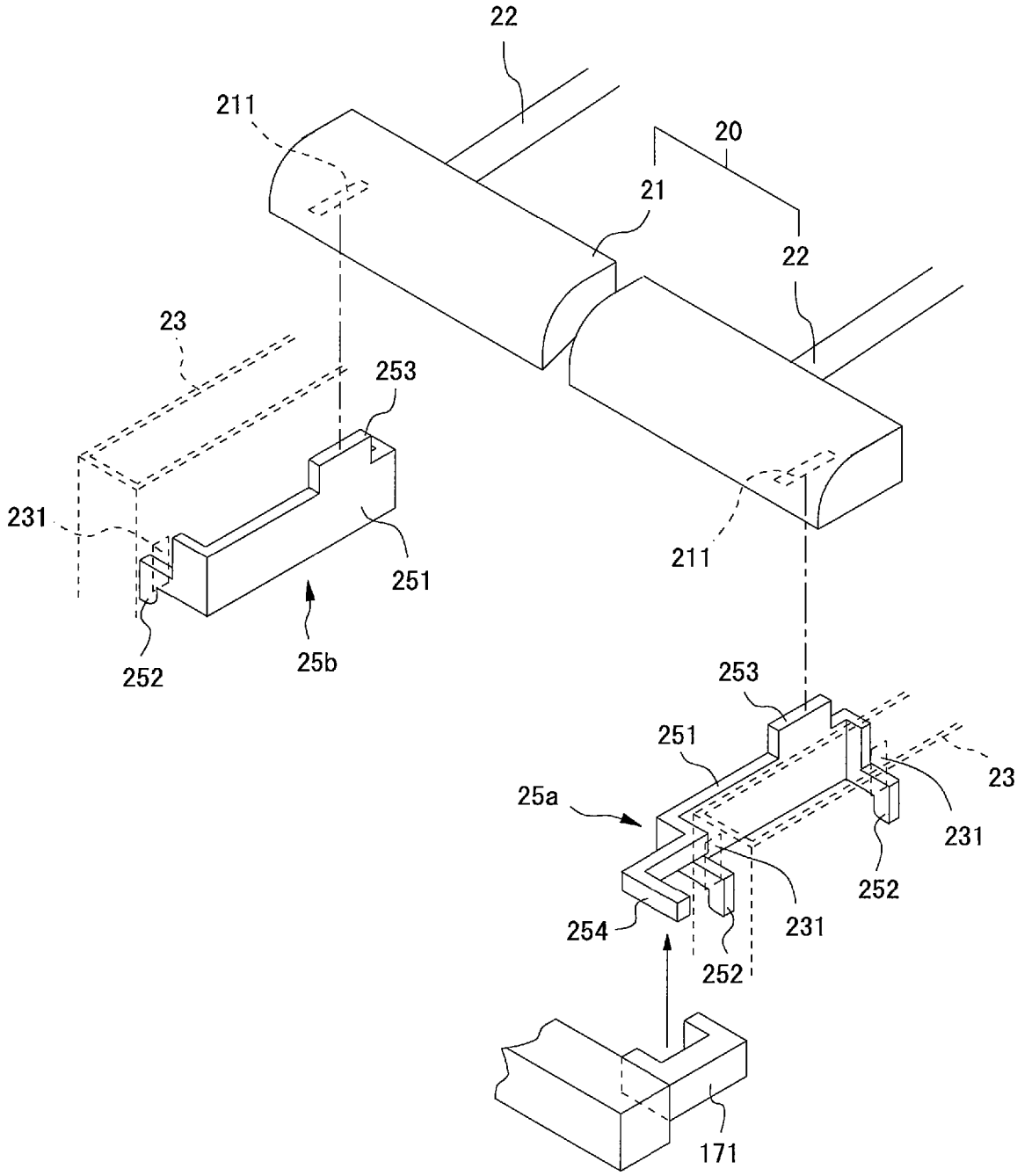
FIG. 3 is an assembly perspective view showing a structure for fixing a first support member to a side wall.

The first support member 21 is a member for supporting the front-side lower part of the commodity columns 3, and as shown in FIG. 3, the right and left thereof are fixed to the side walls 23 of the commodity storage chamber 2 via brackets 25*a* and 25*b*. The first support member 21 is formed into a plate shape. The front surface side thereof is formed into a curved shape, and in portions close to both ends on the lower surface, slender connection holes 211 are formed.

One bracket 25*a* (the right bracket in FIG. 3) of the brackets 25*a* and 25*b* has a base plate 251 that is formed into a plate shape and extends in the front and rear direction. In the front and rear parts of the base plate 251, two hook pieces 252 are formed, and on the upper side of the base plate 251, a connection piece 253 extending upward is provided. Each of the hook pieces 252 is formed into a hook shape directed toward the side wall 23, and is freely engaged with and disengaged from the side surface hook hole 231. The connection piece 253 is freely engaged with and disengaged from the connection hole 211 in the first support member 21.

By this freely engaging/disengaging structure, the first support member 21 is freely attached to and detached from the side walls 23 via the brackets 25*a* and 25*b*. Also, the base plate 251 of one bracket 25*a* has a substantially L-shaped detected element 254. This detected element 254 is detected by a position sensor 171 of the bucket mechanism 17. The other bracket 25*b* (the left bracket in FIG. 3) has the same construction as that of the bracket 25*a* except that it has no detected element.

The second support member 22 is a member for supporting the bottom of the commodity column 3 ranging from the front to the rear. The front end of the second support member 22 is insertedly fixed to the first support member 21, and the rear end thereof is fixed to the back surface 24 by being inserted in the back surface hook hole 232 of the commodity storage chamber 2. The construction is such that the commodity columns 3 are supported in the commodity storage chamber 2 by the first and second support members 21 and 22.

Each of the commodity columns 3 supported by the first and second support members 21 and 22 contains commodities A, and the commodity A is carried out as described below. The bucket mechanism 17 shown in FIG. 1 moves to the commodity column 3. Then, the bucket mechanism 17 receives the commodity A from the commodity column 3, and carries this commodity A to the commodity takeout port 14.

Figure 4:
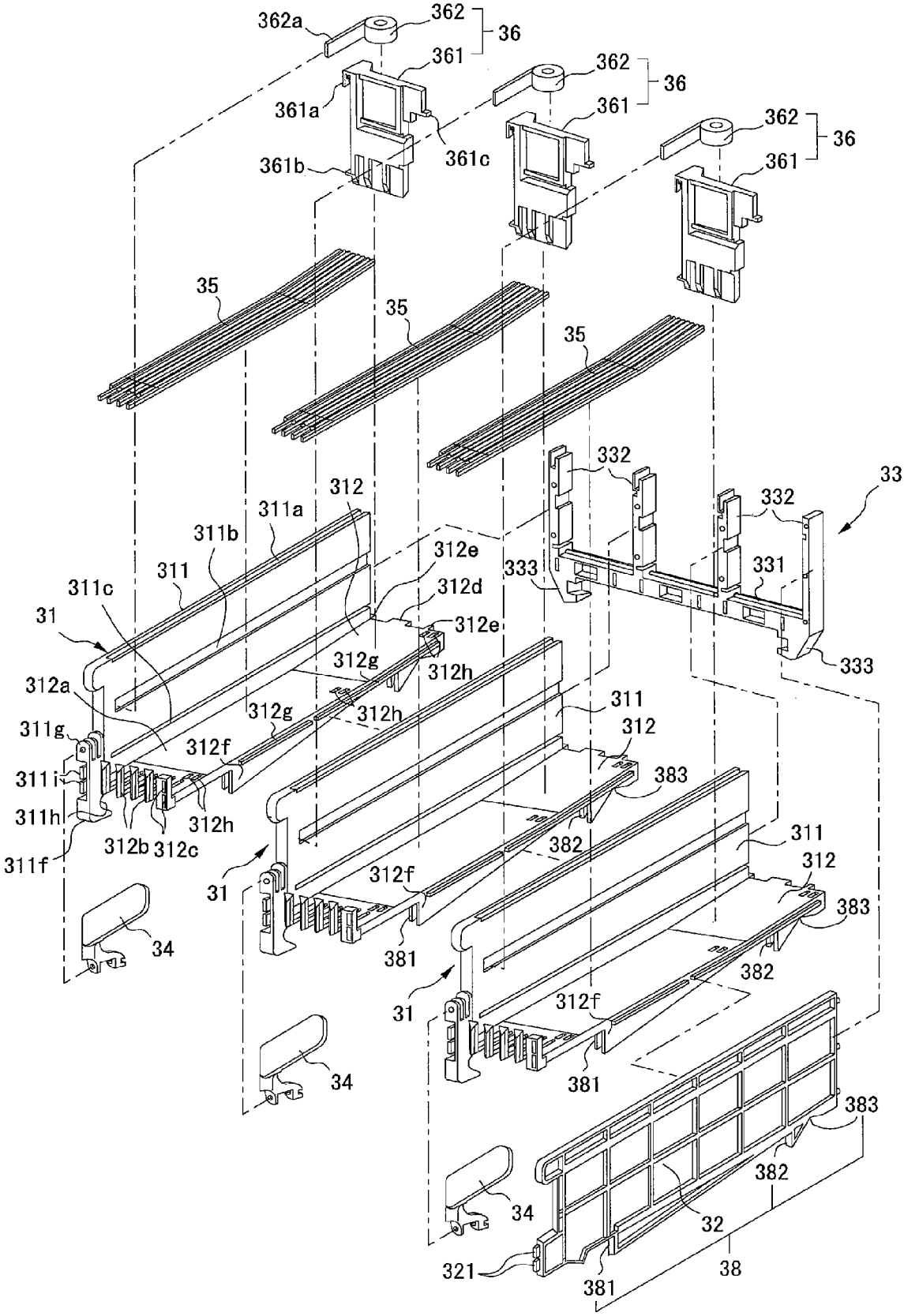
FIG. 4 is an exploded perspective view of a commodity column.

Successively, the construction of the commodity column 3 is explained. As shown in FIG. 4, the commodity column 3 includes three commodity passage members 31, a passage side surface member 32 connected to the commodity passage member 31, a rear end connection member 33 connected to the commodity passage members 31 and the passage side surface member 32, gates 34 for opening and closing the carry-out ports of the commodity passage members 31, sliders 35 for making the slide of commodity in the commodity passage members 31 smooth, and pushers 36 for pressing the commodities A in the commodity passage members 31 forward.

First, the configuration of the commodity passage member 31 is explained mainly with reference to FIG. 4. Each of the commodity passage members 31 is formed by integrally connecting a side wall 311 extending in the front and rear direction to a bottom wall 312 extending from the side wall 311 toward the right direction in FIG. 4.

Figure 8:
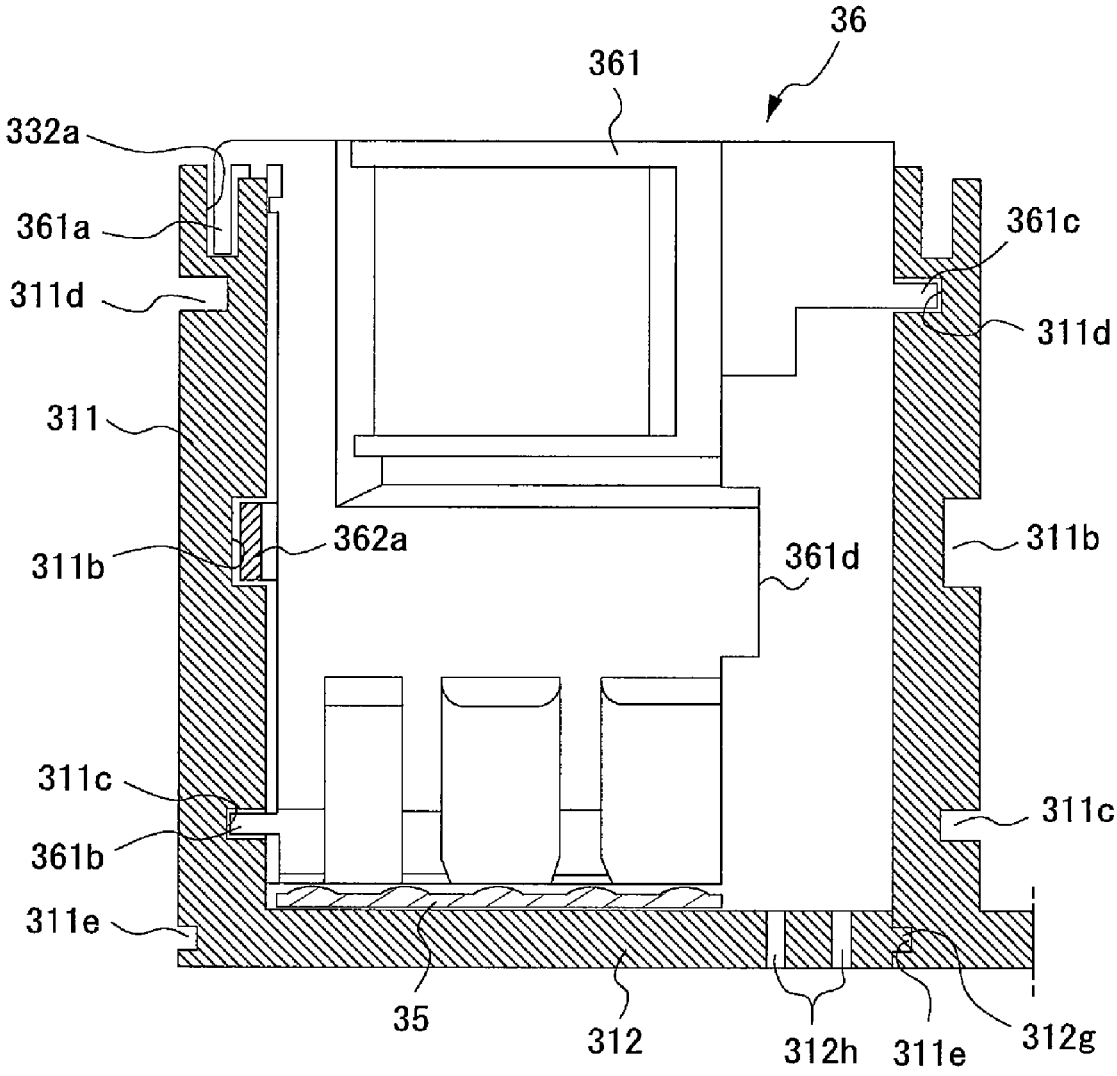
FIG. 8 is a partially omitted front sectional view of a commodity column.

Of the configuration of the commodity passage member 31, the side wall 311 is explained with reference to FIGS. 4 and 8. As shown in FIG. 4, at the upper end of the side wall 311, a pusher first guiding groove 311*a* cut in the front and rear direction is formed. In the approximate center in the up and down direction in the inner surface of the side wall 311, a somewhat wide power spring guiding groove 311*b* is formed, and on the lower side of the inner surface of the side wall 311, a pusher second guiding groove 311*c* is formed in the same manner. As shown in FIG. 8, in the outer surface of the side wall 311, a pusher third guiding groove 311*d* formed by being cut in the front and rear direction and a passage member connecting groove 311*e* are provided. The pusher third guiding groove 311*d* is located slightly below the pusher first guiding groove 311*a*, and the passage member connecting groove 311*e* is located in the lower part of the side wall 311.

As shown in FIG. 4, in the lower part at the tip end of the side wall 311, a gate support part 311*f* extending downward is integrally formed. In the upper part of the gate support part 311*f*, a gate attachment part 311*g* in which the gate 34 is provided so as to be turned in the up and down direction is formed. In the lower part of the gate support part 311*f*, a gripping groove 311*h* for hooking a person's finger is formed. At a position between the gate attachment part 311*g* and the gripping groove 311*h*, engagement claws 311*i* that engage with the adjacent other commodity passage member 31 are formed.

Figure 7:
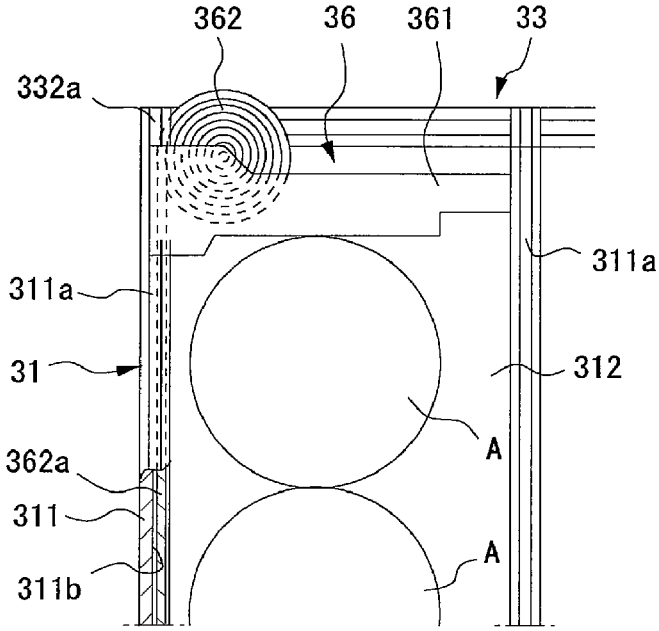
FIG. 7 is a plan view showing an arrangement state of a power spring.

The bottom wall 312 of the commodity passage member 31 is explained mainly with reference to FIG. 4. The bottom wall 312 is in a state of being bent at right angles from the lower end of the side wall 311, and as shown in FIG. 7, the commodities A are mounted in the front and rear direction on the bottom wall 312. The rear part of a commodity mounting surface 312*a* of the bottom wall 312 tilts more steeply than the front part so that the rear commodities A can easily move to the front.

As shown in FIG. 4, at the front end of the bottom wall 312, drop regulating members 312*b* for preventing the commodity A in the front row from dropping and hook holes 312*c* with which the engagement claws 311*i* of the adjacent other commodity passage member 31 engage are formed. As shown in FIG. 4, at the rear end of the bottom wall 312, a plurality of rear surface connection protrusions 312*d* and 312*e* are provided in parallel toward the rear. The central rear surface connection protrusion 312*d* is formed so as to be large, and the rear surface connection protrusions 312*e* located with the rear surface connection protrusion 312*d* being provided therebetween are formed so as to be small.

At the extension end of the bottom wall 312 (the right end of the bottom wall 312 in FIG. 4), a bent plate 312*f* bent downward is provided, and on the side surface of the bent plate 312*f*, two side surface connection protrusions 312*g* extending in the front and rear direction are projectingly provided. Also, the bottom wall 312 is provided with spacer attachment holes 312*h* arranged at a predetermined interval in the right and left direction, and the two spacer attachment holes 312*h* on the right and left are provided at three locations in the front and rear direction in the bottom wall 312.

Figure 5:
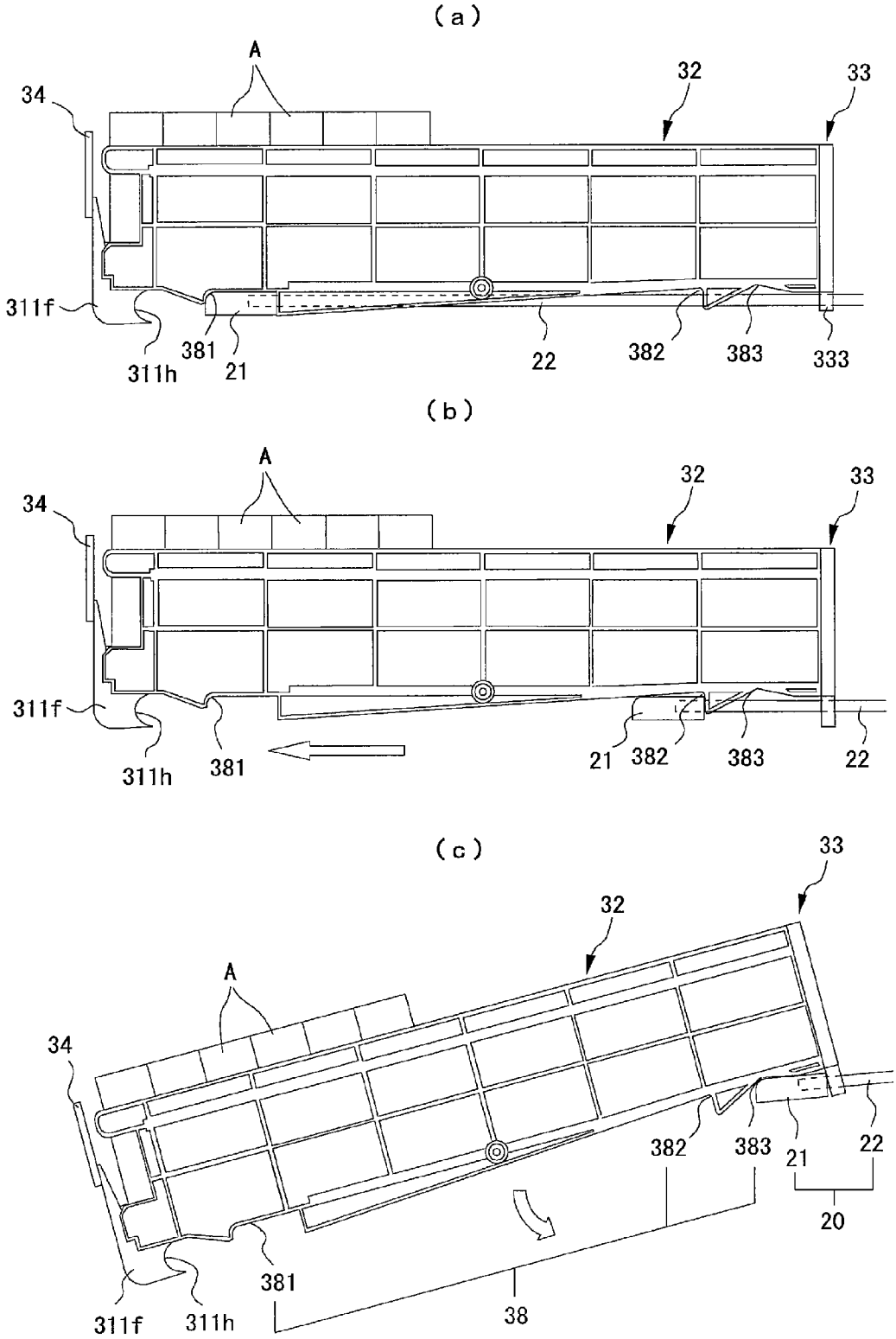
FIG. 5 is a side view showing a tilting state of a commodity column caused by a change in locked position of a first support member.

Successively, the configuration of the passage side surface member 32 is explained mainly with reference to FIGS. 4 and 5. The passage side surface member 32 has a shape similar to that of the side wall 311 of the commodity passage member 31. Also, in the lower part of the passage side surface member 32, a passage connecting groove (not shown) having the same construction as that of the passage member connecting groove 311*e* formed in the side wall 311 is formed. In the upper part of the passage side surface member 32, a pusher third guiding groove (not shown) having the same construction as that of the pusher third guiding groove 311*d* is formed. At the front end of the passage side surface member 32, engagement claws 321 that are the same as the engagement claws 311*i* of the commodity passage member 31 are formed.

As shown in FIGS. 4 and 5, under the bent plate 312*f* of the bottom wall 312 and the passage side surface member 32, which are configured as described above, a support receiving part 38 that makes the first support member 21 capable of being engaged and disengaged is formed.

The support receiving part 38 is formed by a front-side support receiving part 381 and rear-side support receiving parts 382 and 383. The front-side support receiving part 381 engages with the first support member 21 in a standby state of the commodity column 3, and the rear-side support receiving parts 382 and 383 engage with the first support member 21 when the commodity column 3 is pulled out (at the time of maintenance).

The front-side support receiving part 381 is formed in the lower part on the front side of the bent plate 312*f* and the passage side surface member 32. As shown in FIG. 5(*a*), the front-side support receiving part 381 forms a groove that ranges from an approximate center in the up and down direction on the front surface side of the first support member 21 to the upper surface thereof and further covers the whole of the rear surface side thereof (for the bent plate 312*f*, the front surface side of the first support member 21 is open). Thereby, the movement in the front and rear direction of the commodity column 3 is regulated when the front-side support receiving part 381 of the commodity column 3 engages with the first support member 21.

The rear-side support receiving parts 382 and 383 are formed in the front and rear direction in the lower part on the rear side of the bent plate 312*f* and the passage side surface member 32. As shown in FIG. 5(*b*), one rear-side support receiving part 382 forms a groove that covers the upper surface and the rear surface side of the first support member 21, so that the commodity column 3 fitted into the rear-side support receiving part 382 is substantially horizontal (approximately equal tilt angle to that in the standby state). For the other rear-side support receiving part 383, as shown in FIG. 5(*c*), a part covering the upper surface of the first support member 21 tilts slantwise upward. As a result, the commodity column 3 fitted into the rear-side support receiving part 383 is supported in a state of tilting in the counterclockwise direction (tilting so that the front of the commodity column 3 lowers) as indicated by an outline type arrow.

Figure 6:
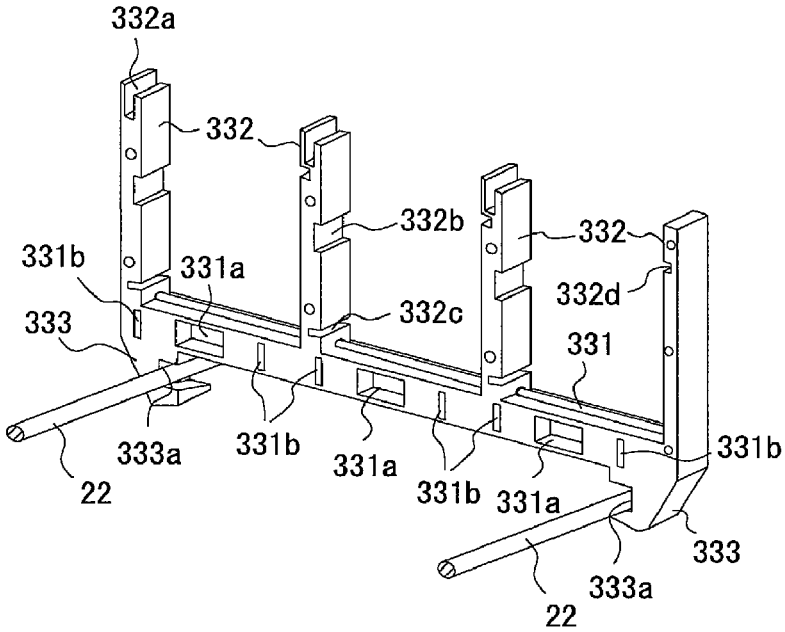
FIG. 6 is a perspective view showing a locked state of a second support member.

Further, the rear end connection member 33 is explained mainly with reference to FIG. 6. The rear end connection member 33 includes a quadrangular prism shaped transverse member 331, four erected pillars 332 arranged at equal intervals on the transverse member 331, and right and left regulating parts 333 formed downward from both right and left ends of the transverse member 331.

As shown in FIG. 6, in the front surface of the transverse member 331, protrusion engagement holes 331*a* formed so as to correspond to the rear surface connection protrusions 312*d* and protrusion engagement holes 331*b* formed so as to correspond to the rear surface connection protrusions 312*e* are provided. Two protrusion engagement holes 331*b* are arranged with the protrusion engagement holes 331*a* being provided therebetween, and three sets of these combinations are formed in the transverse direction (so as to correspond to the three commodity passage members 31).

In each of the three erected pillars 332 on the left-hand side of the erected pillars 332, a first guiding groove inlet 332*a* directed from the upper part to the lower part, a power spring guiding groove inlet 332*b*, and a second guiding groove inlet 332*c* are formed. The first guiding groove inlet 332*a* faces to the pusher first guiding groove 311*a*, the power spring guiding groove inlet 332*b* faces to the power spring guiding groove 311*b*, and the second guiding groove inlet 332*c* faces to the pusher second guiding groove 311*c*. Also, each of the three erected pillars 332 on the right-hand side is formed with a third guiding groove inlet 332*d*. The third guiding groove inlet 332*d* faces to the pusher third guiding groove 311*d* shown in FIG. 8.

As shown in FIG. 6, each of the right and left regulating parts 333 has a supporting groove 333*a* formed by cutting the inside thereof into a square shape. The supporting groove 333*a* is open so as to be larger than the diameter of the second support member 22, and is formed so as to cover the second support member 22 from the outside, so that the rear end of the second support member 22 is inserted through the supporting groove 333*a* with a play. Also, the interval between the two right and left regulating parts 333 is equal to the interval between the adjacent right and left second support members 22. Thereby, the commodity column 3 is supported by the second support members 22 from the downside, and the movement in the right and left direction of the commodity column 3 is regulated so that the commodity column 3 does not shift to the right or left.

As shown in FIG. 1, the gate 34 is an element for preventing the commodity A located at the foremost end of the commodity passage member 31 from dropping. As shown in FIG. 4, the gate 34 is attached to the gate attachment part 311*g* of the commodity passage member 31 to open and close the carry-out port of the commodity passage member 31.

As shown in FIG. 4, the slider 35 is provided on the bottom wall 312 of the commodity passage member 31, and is formed in the front and rear direction over the entire of the bottom wall 312. The upper surface of the slider 35 is curved to decrease the frictional resistance against the commodity A. Thereby, the commodity A can move in the front direction smoothly.

As shown in FIG. 7, the pusher 36 is formed by a pressing plate 361 having a rectangularly shape extending in the up and down direction as a whole and a power spring 362 that is a driving source. The urging force of the power spring 362 acts so as to press the commodity A at the rearmost end from the rear toward the front through the pressing plate 361.

At one upper end of the pressing plate 361, an inverse L shaped first guide piece 361*a* is formed. In the lower part of the pressing plate 361, a second guide piece 361*b* projecting to the outside is formed. In the upper part of the pressing plate 361, a third guide piece 361*c* is formed on the side reverse to the first guide piece 361*a*. The first guide piece 361*a* is inserted in the pusher first guiding groove 311*a* through the first guiding groove inlet 332*a*. The second guide piece 361*b* is inserted in the pusher second guiding groove 311*c* through the second guiding groove inlet 332*c*. The third guide piece 361*c* is inserted in the pusher third guiding groove 311*d* through the third guiding groove inlet 332*d*. Also, on the side surface on the third guide piece 361*c* side of the side surfaces of the pressing plate 361, a convex part 361*d* projecting in a rectangular shape is formed.

As shown in FIG. 7, the power spring 362 is disposed on the rear surface of the pressing plate 361. A pulled-out spring piece 362*a* of the power spring 362 is arranged in the power spring guiding groove inlet 332*b* and the power spring guiding groove 311*b*, and the tip end of the spring piece 362*a* is connected to the front end of the power spring guiding groove 311*b*. Thereby, the restoring force of the power spring 362 is applied to the pressing plate 361 as a forward pressing force, so that the pressing plate 361 is pressed toward the front.

The commodity column 3 configured as described above is assembled as described below. The method for assembling the commodity column 3 is explained mainly with reference to FIG. 4.

First, the three commodity passage members 31 are arranged in the right and left direction. When the commodity passage members 31 are connected to each other, the commodity passage members 31 are assembled as described below.

The engagement claws 311*i* of one commodity passage member 31 is inserted into the hook holes 312*c* in the other adjacent commodity passage member 31 to connect the front end sides of the commodity passage members 31 to each other. Thereby, the commodity passage members 31 are positioned each other. Next, as shown in FIG. 8, the side surface connection protrusions 312*g* formed at the extension end of one commodity passage member 31 is fitted into the passage member connecting groove 311*e* in the other adjacent commodity passage member 31 to connect the commodity passage members 31 to each other. Thereby, the commodity passage members 31 adjacent to each other in the right and left direction are connected to each other. By repeating this connecting work, the three commodity passage members 31 are connected to each other.

After the connecting work for the commodity passage members 31 has been finished, the passage side surface member 32 is connected to the side surface of the commodity column member 31 located at the farthest end of the commodity passage members 31. Specifically, the engagement claws 321 of the passage side surface member 32 are inserted into the hook holes 312*c* in the commodity passage member 31, and the side surface connection protrusions 312*g* are fitted into the passage member connecting groove (not shown) of the passage side surface member 32. Thereby, the passage side surface member 32 is connected to the commodity passage members 31.

By assembling as described above, one commodity arrangement passage is formed in each of the commodity passage members 31, and resultantly, three commodity arrangement passages are formed in one commodity column 3.

After the above-described assembling work of the passage side surface member 32 to the commodity passage members 31 has been finished, the rear end connection member 33 is attached by the procedure described below to enhance the connecting strength of the commodity passage members 31 and the passage side surface member 32. Specifically, as shown in FIG. 4, the rear end connection member 33 is arranged at the rear of the commodity passage members 31. The transverse member 331 is caused to face to the rear ends of the bottom walls 312 of the commodity passage members 31, and the erected pillars 332 are caused to face to the rear ends of the side walls 311 and the passage side surface member 32. Next, the rear surface connection protrusions 312*d* of the commodity passage members 31 are fitted into the protrusion engagement holes 331*a* in the rear end connection member 33, and the rear surface connection protrusions 312*e* are fitted into the protrusion engagement holes 331*b*. Thereby, the commodity passage members 31 and the passage side surface member 32 are firmly connected to each other by the rear end connection member 33. To further enhance the connecting strength, the erected pillars 332 may be fastened to the side walls 311 and the passage side surface member 32 by using screws or the like.

After the connecting work of the rear end connection member 33 has been finished, as shown in FIG. 4, the sliders 35 are placed on the commodity mounting surfaces 312*a* of the commodity passage members 31, and gates 34 are attached to the gate attachment parts 311*g* of the commodity passage members 31 (the gates 34 may be attached in advance before the commodity passage members 31 are assembled).

Next, the pushers 36 are assembled by the procedure described below. First, the power spring 362 is installed in advance on the rear surface of the pressing plate 361. Then, the pusher 36 is placed so as to face to the commodity passage member 31 at the rear of the rear end connection member 33. Thereafter, the first guide piece 361*a* of the pusher 36 is moved into the pusher first guiding groove 311*a* via the first guiding groove inlet 332*a*, the second guide piece 361*b* of the pusher 36 is moved into the pusher second guiding groove 311*c* via the second guiding groove inlet 332*c*, and the third guide piece 361*c* of the pusher 36 is moved into the pusher third guiding groove 311*d* via the third guiding groove inlet 332*d*. On the other hand, the spring piece 362*a* of the power spring 362 is arranged in the power spring guiding groove 311*b* via the power spring guiding groove inlet 332*b*, and the tip end of the spring piece 362*a* is fixed to the tip end of the power spring guiding groove 311*b*.

By the above-described assembling process, the commodity column 3 is formed. When the commodity column 3 is arranged in the commodity storage chamber 2, as shown in FIG. 2, the front-side support receiving part 381 of the commodity column 3 is placed on the first support member 21, and as shown in FIG. 6, the second support members 22 are inserted into the supporting grooves 333*a* in the right and left regulating parts 333. Thereby, the commodity column 3 is placed in the commodity storage chamber 2, and as shown in FIG. 1, the plurality of commodity columns 3 are arranged in the commodity storage chamber 2.

In the vending machine 1 in accordance with this embodiment, both of the first support member 21 and the second support member 22 for supporting the commodity column 3 are arranged under the commodity column 3, and the commodity column 3 is supported from the downside, so that a space for providing a support member on the outside of the side wall 311 of the commodity column 3 as in the conventional example need not be provided. Therefore, for a space W1 formed between the adjacent commodity columns 3 as shown in FIG. 1, a space W1 of a degree such that the commodity columns 3 do not come into contact with each other when the commodity column 3 is put in or taken out suffices, so that the storage quantity of commodity increases corresponding to the decrease in the space W1.

Also, when the commodities A are replenished in the commodity column 3, first, the front-side support receiving parts 381 are detached from the first support member 21. Thereafter, the commodity column 3 is pulled out to the front of the commodity storage chamber 2, either of the rear-side support receiving parts 382 and 383 is selected, and the selected part is supported on the first support member 21.

When the pulled-out commodity column 3 is located in an upper part of the commodity storage chamber 2, for example, the rear-side support receiving parts 383 located at the rear are selected, and, as shown in FIG. 5(*c*), the rear-side support receiving parts 383 are fitted on the first support member 21. Thereby, the commodity column 3 is supported in a state of tilting downward with the rear-side support receiving part 383 being the center, so that the commodity replenishing work is easy. On the other hand, when the pulled-out commodity column 3 is located in a lower part of the commodity storage chamber 2, for example, the rear-side support receiving parts 382 located in the front are selected, and, as shown in FIG. 5(*b*), the rear-side support receiving parts 382 are fitted on the first support member 21. Thereby, the commodity column 3 is supported in a state of scarcely tilting, so that the commodity replenishing work is easy.

Also, since the gripping grooves 311*h* for hooking a person's finger are formed in the lower part of the front-side of the commodity column 3, the commodity column 3 can easily be moved in the front and rear direction by gripping the gripping groove 311*h* with the fingers.

Further, since the bracket 25*a* having the detected element 254 can freely be engaged with and disengaged from the connection hole 211 in the first support member 21, and can freely be engaged with and disengaged from the side surface hook holes 231 in the side wall 23, even if a trouble occurs on the detected element 254, the bracket 25*a*, which is a small part, has only to be exchanged.

What is claimed is:

1. A vending machine comprising:

a commodity column in which commodities are arranged in a first direction which is parallel to a commodity conveying direction of the commodity column;

a support part disposed inside a commodity storage chamber, the support part comprises:

a first support member extending in a second direction which is substantially perpendicular to the commodity conveying direction of the commodity column and a second support member extending in the first direction, and wherein the commodity column is supported by the support part so that the commodity column is configured to move in the first direction on the first and second support members;

a support receiving part which is supported so as to be freely engaged with and disengaged from the first support member, and is formed integrally with the commodity column on an underside of the commodity column so as to regulate the movement of the commodity column in the first direction; and a right and left regulating part configured to regulate the movement of the commodity column in the second direction by engaging the second support member.

2. The vending machine according to claim 1, wherein the support receiving part comprises a front-side support receiving part formed in a lower part on a downstream side of the commodity column in the commodity conveying direction and a plurality of rear-side support receiving parts formed in the front and rear in the lower part on a upstream side of the commodity column in the commodity conveying direction, and the rear-side support receiving parts are formed so that the commodity column is tilted in an angle when the commodity column is in a locked position.

3. The vending machine according to claim 1, wherein a gripping part configured to engage with a user's finger is provided in a lower part on a downstream side of the commodity column in the commodity conveying direction.

4. The vending machine according to claim 2, wherein a gripping part configured to engage with a user's finger is provided in the lower part on the downstream side of the commodity column in the commodity conveying direction.

5. The vending machine according to claim 1, wherein the vending machine further comprises:

a bucket mechanism configured to move vertically and to receive a commodity conveyed from the commodity column;

a bracket configured to detachably mount the first support member on a side wall of the commodity storage chamber; and a detection part provided on the bracket and configured to detect a vertical position of the bucket mechanism.

6. The vending machine according to claim 2, wherein the vending machine further comprises:

a bucket mechanism configured to move vertically and to receive a commodity conveyed from the commodity column;

a bracket configured to detachably mount the first support member on a side wall of the commodity storage chamber; and a detection part provided on the bracket and configured to detect a vertical position of the bucket mechanism.

7. The vending machine according to claim 3, wherein the vending machine further comprises:

a bucket mechanism configured to move vertically and to receive a commodity conveyed from the commodity column;

a bracket configured to detachably mount the first support member on a side wall of the commodity storage chamber; and a detection part provided on the bracket and configured to detect a vertical position of the bucket mechanism.

8. The vending machine according to claim 4, wherein the vending machine further comprises:

a bucket mechanism configured to move vertically and to receive a commodity conveyed from the commodity column;

a bracket configured to detachably mount the first support member on a side wall of the commodity storage chamber; and a detection part provided on the bracket and configured to detect a vertical position of the bucket mechanism.

* * * * *